US011512832B2

(12) United States Patent
Deng et al.

(10) Patent No.: US 11,512,832 B2
(45) Date of Patent: Nov. 29, 2022

(54) LIGHT BULB AND CRYSTAL LAMP

(71) Applicant: OPPLE LIGHTING CO., LTD., Shanghai (CN)

(72) Inventors: Shitao Deng, Shanghai (CN); Song Yin, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 17/134,669

(22) Filed: Dec. 28, 2020

(65) Prior Publication Data

US 2021/0116098 A1 Apr. 22, 2021

Related U.S. Application Data

(63) Continuation of application No. PCT/CN2019/091740, filed on Jun. 18, 2019.

(30) Foreign Application Priority Data

Jun. 26, 2018 (CN) ..... 201810668438.5
Jun. 26, 2018 (CN) ..... 201820994052.9

(51) Int. Cl.
*F21V 1/00* (2006.01)
*F21V 5/00* (2018.01)
(Continued)

(52) U.S. Cl.
CPC ..... *F21V 5/004* (2013.01); *F21K 9/232* (2016.08); *F21V 3/02* (2013.01); *F21V 19/001* (2013.01);
(Continued)

(58) Field of Classification Search
CPC . F21K 9/232; F21K 9/233; F21K 9/65; F21K 9/23; F21K 9/69; F21Y 2107/30;
(Continued)

(56) References Cited

U.S. PATENT DOCUMENTS 8,033,691 B2 10/2011 Bierhuizen et al.
8,820,966 B2 * 9/2014 Igaki ..... F21V 3/049 362/256
(Continued)

FOREIGN PATENT DOCUMENTS

CN 102422081 A 4/2012
CN 202927518 U 5/2013
(Continued)

OTHER PUBLICATIONS

International Search Report of PCT Application No. PCT/CN2019/091740 dated Sep. 25, 2019 and English translation, (6p).

*Primary Examiner* — Omar Rojas Cadima
(74) *Attorney, Agent, or Firm* — Arch & Lake LLP

(57) ABSTRACT

The present disclosure discloses a light bulb and a crystal lamp. The light bulb includes a light emitting module and a light-transmitting cover; the light emitting module includes a mounting column and a plurality of LED lamp beads, the mounting column includes a circumferential surface and a top surface, and the plurality of LED lamp beads are arranged at least on the circumferential surface; the light-transmitting cover is arranged to cover a periphery of the light emitting module and distributes light for the plurality of LED lamp beads, the light-transmitting cover includes a plurality of micro-lens units, and each of the plurality of micro-lens units has a light incident surface and a light exit surface, and is in a configuration of converging light from the light incident surface to the light exit surface.

20 Claims, 5 Drawing Sheets

(51) Int. Cl.

| | |
|---|---|
| ***F21K 9/232*** | (2016.01) |
| ***F21V 3/02*** | (2006.01) |
| ***F21V 19/00*** | (2006.01) |
| *F21Y 107/30* | (2016.01) |
| *F21Y 115/10* | (2016.01) |

(52) U.S. Cl.
CPC ..... *F21Y 2107/30* (2016.08); *F21Y 2115/10* (2016.08)

(58) Field of Classification Search
CPC ..... F21Y 2107/40; F21Y 2115/10; F21Y 2107/00; F21Y 2107/90; F21V 3/049; F21V 19/001; F21V 5/004; F21V 5/007; F21V 5/002; F21V 7/041; F21V 5/005; F21V 5/02; F21V 5/008; G02B 19/0028; G02B 3/08; G02B 19/0066; G02B 3/0062; G02F 1/133606; G02F 1/133607

See application file for complete search history.

(56) References Cited

U.S. PATENT DOCUMENTS

| | | | | |
|---|---|---|---|---|
| 9,632,214 | B2 | 4/2017 | Streppel et al. | |
| 2002/0191396 | A1* | 12/2002 | Reiff | F21K 9/65 362/246 |
| 2006/0267037 | A1* | 11/2006 | Lim | F21V 5/008 257/98 |
| 2013/0194811 | A1* | 8/2013 | Benitez | G02B 27/0961 362/311.1 |
| 2013/0200410 | A1* | 8/2013 | Kim | F21V 5/04 257/91 |
| 2015/0084497 | A1* | 3/2015 | Nourbakhsh | F21V 3/049 313/116 |
| 2016/0327236 | A1* | 11/2016 | Benitez | F21V 23/0457 |

FOREIGN PATENT DOCUMENTS

| | | | |
|---|---|---|---|
| CN | 103429952 | A | 12/2013 |
| CN | 103499043 | A | 1/2014 |
| CN | 205244916 | U | 5/2016 |
| CN | 107830426 | A | 3/2018 |
| CN | 108591897 | A | 9/2018 |
| CN | 208222272 | U | 12/2018 |
| WO | 2013041273 | A1 | 3/2013 |

* cited by examiner

120

LIGHT BULB AND CRYSTAL LAMP

CROSS-REFERENCE TO RELATED APPLICATIONS

This application is based upon and claims the priority of PCT patent application No. PCT/CN2019/091740 filed on Jun. 18, 2019 which claims priority to the Chinese patent application No. 201810668438.5 filed on Jun. 26, 2018 and the Chinese patent application No. 201820994052.9 filed on Jun. 26, 2018, the entire content of both of which is hereby incorporated by reference herein for all purposes.

TECHNICAL FIELD

The present disclosure relates to a field of lighting technology, in particular to a light bulb and a crystal lamp.

BACKGROUND

In the field of lighting, the crystal lamp is loved and purchased by many consumers because the crystal lamp can bring elegance and fashion to the room. With the development of optical fiber and diode technology, the crystal lamp is more miniature, lighter, and more suitable for modern-style home decoration. Combined with the development of crystal cutting technology, the crystal lamp has become more compact, and has very modern lines and dream-like colors, so that the crystal lamp will become a highlight of the modern living room. With the advancement and development of these technologies, crystal lamps still occupy a very important position in the market and are still favored by consumers.

SUMMARY

Examples of the present disclosure provide a light bulb and a crystal lamp.

In a first aspect, an example of the present disclosure provides a light bulb comprising a light emitting module and a light-transmitting cover, the light emitting module comprises a mounting column and a plurality of LED lamp beads, the mounting column comprises a circumferential surface and a top surface, and the plurality of LED lamp beads are disposed at least on the circumferential surface; the light-transmitting cover is disposed to cover a periphery of the light emitting module and distributes light for the plurality of LED lamp beads, the light-transmitting cover comprises a plurality of micro-lens units, and each of the plurality of micro-lens units has a light incident surface and a light exit surface, and is configured to converge light from the light incident surface to the light exit surface, all the plurality of micro-lens units are sequentially connected to form the light-transmitting cover, and each light incident surface faces the light emitting module, and each light exit surface is away from the light emitting module.

In a second aspect, an example of the present disclosure provides a crystal lamp, the crystal lamp comprises a crystal decoration and a light bulb comprising a light emitting module and a light-transmitting cover, wherein light emitted by the light bulb is capable of irradiating the crystal decoration; wherein the light emitting module comprises a mounting column and a plurality of LED lamp beads, the mounting column comprises a circumferential surface and a top surface, and the plurality of LED lamp beads are disposed at least on the circumferential surface; and wherein the light-transmitting cover is disposed to cover a periphery of the light emitting module and distributes light for the plurality of LED lamp beads, the light-transmitting cover comprises a plurality of micro-lens units, and each of the plurality of micro-lens units comprises a light incident surface and a light exit surface, and is configured to converge light from the light incident surface to the light exit surface, all the plurality of micro-lens units are sequentially connected to form the light-transmitting cover, and each light incident surface faces the light emitting module, and each light exit surface is away from the light emitting module.

It is to be understood that both the foregoing general description and the following detailed description are exemplary and explanatory only and are not restrictive of the present disclosure.

BRIEF DESCRIPTION OF THE DRAWINGS

The drawings described here are used to provide a further understanding of the present disclosure and constitute a part of the present disclosure. The examples and descriptions of the present disclosure are used to explain the present disclosure, and do not constitute an improper limitation on the present disclosure. In the drawings:

FIG. 5-FIG. 7 are cross-sectional views of micro-lens units disclosed by an example of the present disclosure in a direction parallel to a direction from a light incident surface to a light exit surface; in which:

FIG. 5 shows that only the light incident surface is a curved line in the cross section of the micro-lens unit;

FIG. 6 shows that only the light exit surface is a curved line in the cross section of the micro-lens unit;

FIG. 7 shows that both the light incident surface and the light exit surface are curved lines in the cross section of the micro-lens unit;

DETAILED DESCRIPTION

Figure 1:
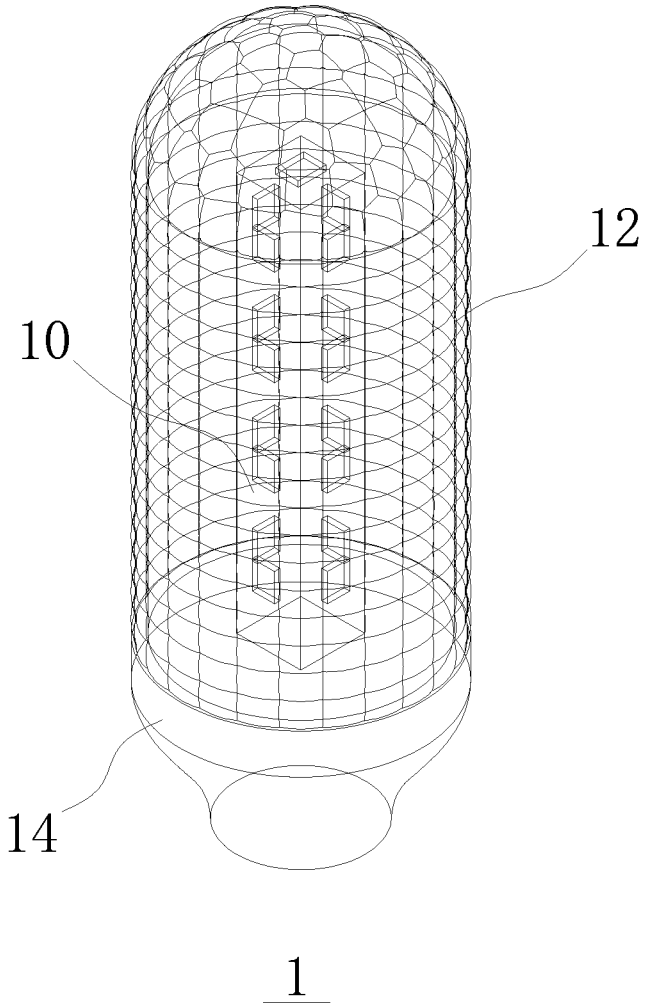
FIG. 1 is a stereoscopic view of a light bulb disclosed by an example of the present disclosure.
Figure 2:
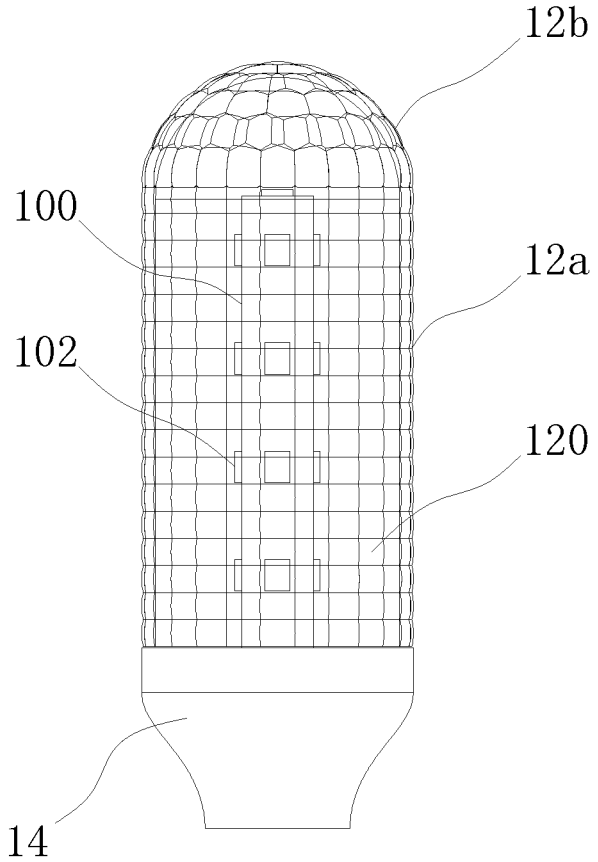
FIG. 2 is a front view of a light bulb disclosed by an example of the present disclosure.
Figure 3:
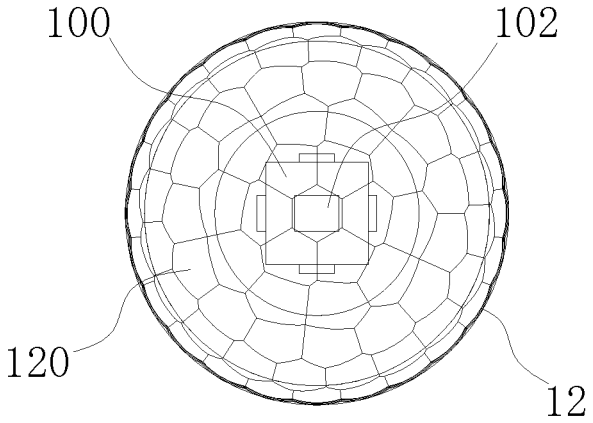
FIG. 3 is a top view of a light bulb disclosed by an example of the present disclosure.
Figure 4:
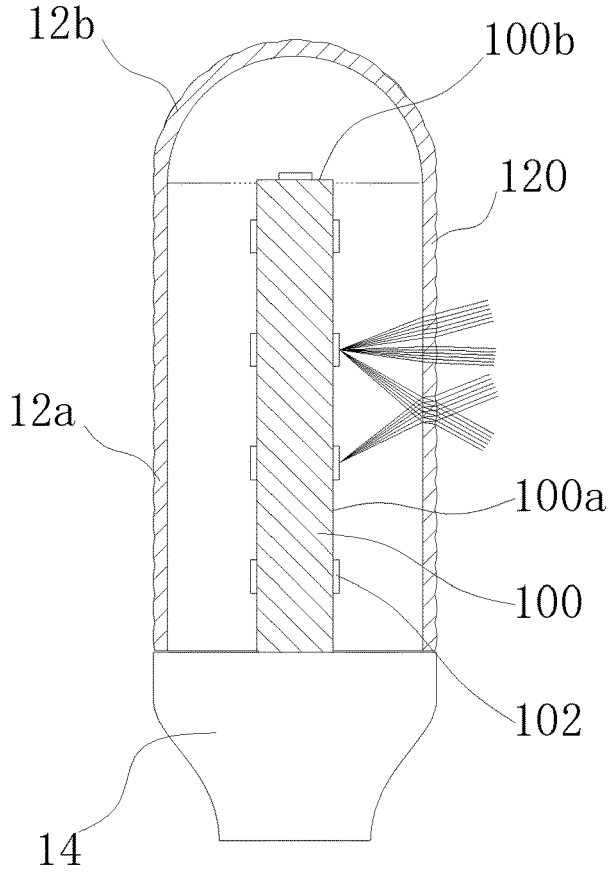
FIG. 4 is a cross-sectional view of light distribution of a light bulb disclosed by an example of the present disclosure.

The technical solutions of the present disclosure are described in a clearly and fully understandable way in connection with the examples and corresponding accompanying drawings of the present disclosure. It is apparent that the described examples are just a part but not all of the examples of the disclosure. Based on the examples in the present disclosure, those skilled in the art may obtain other examples, without any creative work, which shall be within the scope of the disclosure.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

The candle crystal lamp is a kind of crystal lamp. The light source is a candle-shaped bulb, which is shaped like a candle. The whole lamp body is similar to a candlestick, so it is called a candle crystal lamp. Through the reflection of the crystal beads, the candle bulb is shining, unusually bright, and can emit colorful light, the candle bulb is very beautiful and deeply loved by modern consumers.

The reference numerals used in this disclosure may include:

1—light bulb; 10—light emitting module; 100—mounting column; 100*a*—circumferential surface; 100*b*—top surface; 102—LED lamp bead; 12—light-transmitting cover; 12*a*—cylindrical portion; 12*b*—hemispherical portion; 120—micro-lens unit; 120*a*—light incident surface; 120*b*—light exit surface; 14—lamp holder; 140—electrical connection interface; 2—crystal decoration; 3—lamp cap; 4—lamp stand.

In order to make the crystal illuminated more dazzlingly, the candle-shaped bulbs in the related technology are all made of a single high-power LED lamp bead with a candle-shaped bulb.

However, this candle-shaped bulb only improves the brilliance of the crystal by increasing the light intensity so that more light is refracted and reflected by the crystal. However, because the light emitted by this candle-shaped bulb is too strong, it is very glaring, which seriously affects the visual senses.

The light bulb and the crystal lamp disclosed by the examples of the present disclosure are provided with a plurality of LED lamp beads to emit light together. The light intensity of a single LED lamp bead is low, the light is softer, and no glare is generated. At the same time, through adopting a light-transmitting cover including the micro-lens units to distribute light for the LED lamp beads, the convex lens configuration of each micro-lens unit can converge the divergent light emitted from the LED lamp beads to themselves, thereby forming more concentrated light beams, these light beams can form uniform reflection or refracted light after irradiating the crystal decoration, thus making the crystal decoration more dazzling.

In the following, technical solutions of each example of the present disclosure will be described in detail with reference to the accompanying drawings.

Figure 8:
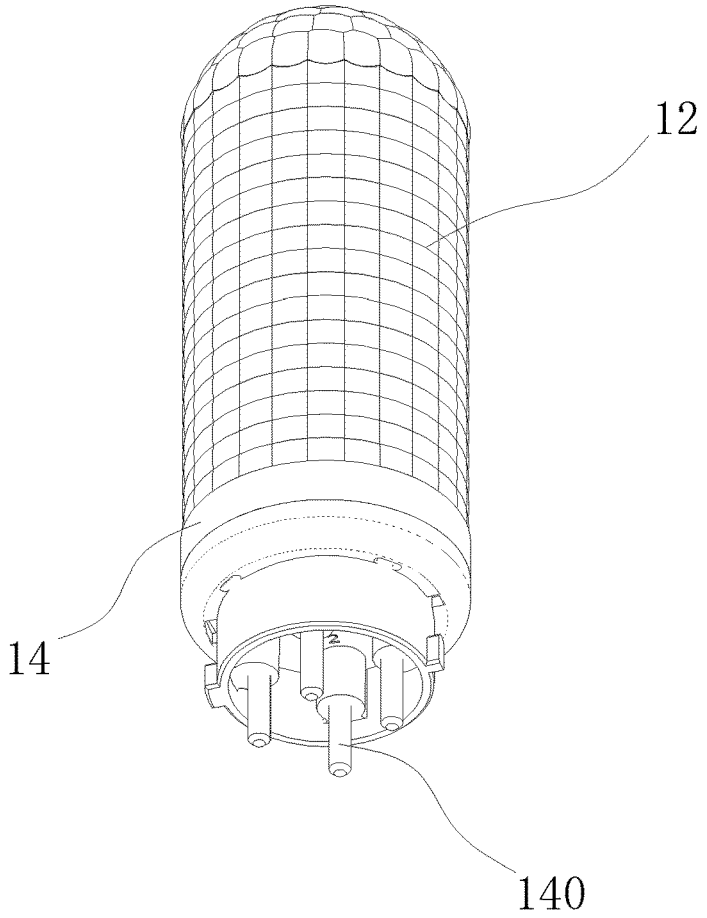
FIG. 8 is a structural view of a light bulb including a plug post disclosed by an example of the present disclosure.

Examples of the present disclosure disclose a light bulb 1, the light bulb 1 can be used in a crystal lamp with a crystal decoration 2 for lighting, so that the crystal decoration can emit light in dazzling brilliance. As shown in FIG. 1 to FIG. 4, the light bulb 1 in this example includes a light emitting module 10 and a light-transmitting cover 12. In order to fix the light emitting module 10 and the light-transmitting cover 12, the light bulb may further include a lamp holder 14. The lamp holder 14 is a supporting and fixing structure, and the light emitting module 10 and the light-transmitting cover 12 can be fixedly arranged on the lamp holder 14, so as to adapt to different connection requirements. In addition, an electrical connection interface 140 is usually provided at an end of the lamp holder 14. The lamp holder 14 may be of different types. For example, the lamp holder 14 of E14 type, E27 type, etc. has a threaded electrical connection interface 140, or the lamp holder 14 of the G10 type has an electrical connection interface 140 with a plug post (referring to FIG. 8). Through the electrical connection interface 140, the light bulb can be connected to a lamp cap of the crystal lamp to obtain electric energy and receive control to adjust the intensity, color, or the like.

The light emitting module 10 includes a mounting column 100 and a plurality of LED lamp beads 102. The mounting column 100 includes a circumferential surface 100*a* and a top surface 100*b*. The plurality of LED lamp beads 102 are arranged at least on the circumferential surface 100*a*. In order to make the illumination more uniform, the plurality of LED lamp beads 102 may usually be arranged on the circumferential surface 100*a* in a certain arrangement manner, for example, the plurality of LED lamp beads 102 may be arranged along a circumferential direction of the mounting column 100, or along an axial direction of the mounting column 100, or along both the circumferential direction and the axial direction of the mounting column 100. The arrangement result may be in a spiral shape, a regular matrix, etc. In addition, the LED lamp beads 102 may be arranged in an aligned manner, or may be arranged in a staggered manner.

Figure 5:
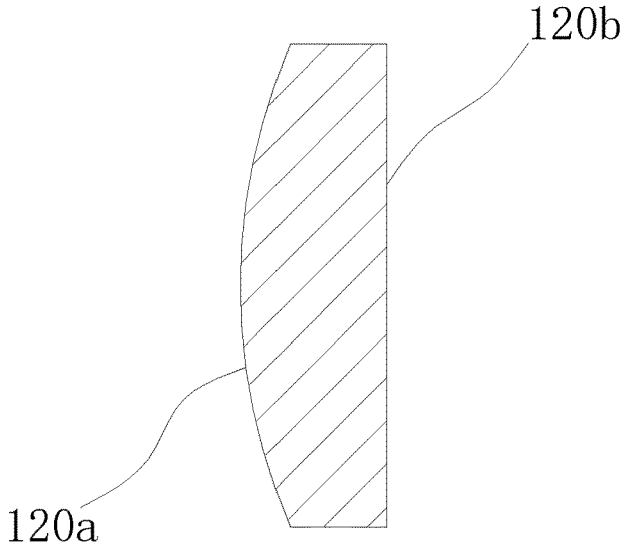
Figure 6:
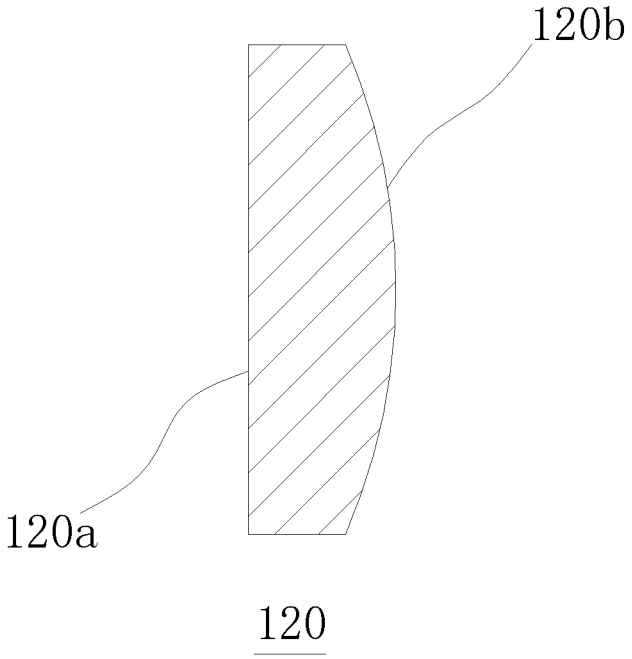
Figure 7:
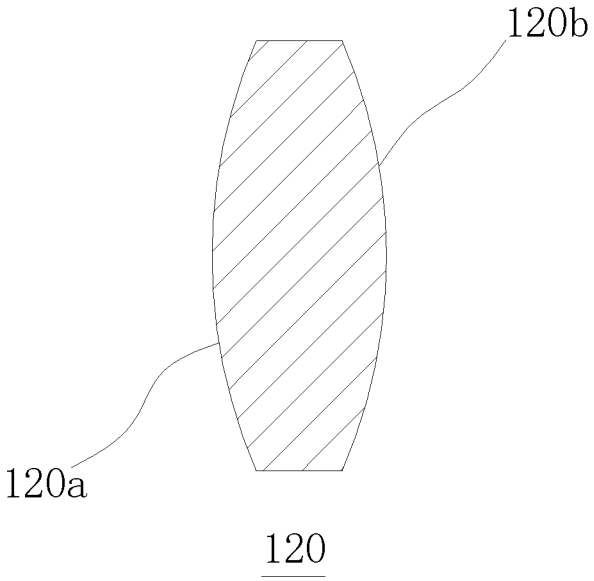

The light-transmitting cover 12 is a light distribution component of the light emitting module 10, and the light-transmitting cover 12 is arranged to cover the periphery of the light emitting module 10 and distributes light for the LED lamp beads 102. Specifically, as shown in FIG. 5 to FIG. 7, the light-transmitting cover 12 includes a plurality of micro-lens units 120. Each micro-lens unit 120 has a light incident surface 120*a* and a light exit surface 120*b*. The light emitting surface is in a configuration of converging light from the light incident surface to the light exit surface. The light emitted by the point light source is scattered light, that is, the light will scatter in all directions around the point light source. A small part of the light will irradiate the light incident surface 120*a* of the same micro-lens unit 120. Because the light is emitted and scattered by the same point light source, the rays in the light are not parallel to each other, and there will be a certain angle difference. The magnitude of the angle difference is generally related to the area of the light incident surface 120*a* and the distance between the micro-lens unit 120 and the point light source.

We call the angle difference between two light rays with the largest angle difference among all the light rays that are emitted by a point light source and irradiated on the same light incident surface 120*a* as a maximum angle difference. The function of the micro-lens unit 120 is to make a beam of scattered light, after entering the light incident surface 120*a* and emitted out from the light exit surface 120*b*, emitted by a point light source become more concentrated, so that the maximum angle difference of the emitted light is greatly reduced relative to the maximum angle difference of the incident light.

All the micro-lens units 120 are connected in sequence to form the light-transmitting cover 12, the light incident surface 120*a* of each micro-lens unit 120 faces the light emitting module 10, and the light exit surface 120*b* of each micro-lens unit is away from the light emitting module 10.

Each LED lamp bead 102 can be regarded as a single point light source, and the LED lamp bead 102 emits scattered light in a large angle range. The scattered light rays irradiate the light-transmitting cover 12 and respectively enter the light incident surfaces 120*a* of different micro-lens units 120. Each micro-lens unit 120 will distribute the light entering the micro-lens unit 120 to make the light more concentrated. Therefore, the scattered light emitted by a single LED lamp bead 102 will be distributed by the plurality of micro-lens units 120 into a plurality of concentrated light beams (referring to FIG. 4). These light beams can form a uniform reflection or refracted light after irradiating the crystal decoration, thereby making the crystal decoration more dazzling.

In this case, because the present example adopts a light emitting method in which a plurality of LED lamp beads 102 emit light together, the light sources are relatively dispersed, and the light intensity of a single LED lamp bead 102 is lower, and the light is softer, so that no glare is generated. The dispersedly arranged LED lamp beads 102 also expand the position of the light sources and increase the path of the light beams, thereby increasing the probability that the light reflected or refracted by the crystal decoration is observed by people, thus making the crystal decoration more eye-catching.

In order to further improve the brilliance of the crystal decoration, the closer the light beam distributed through the micro-lens units 120 is to the parallel light, the better. However, because the light-transmitting cover 12 is integrally covered on the periphery of the light emitting module 10 and not only covered on the periphery of one of the LED lamp beads 102, the distances and relative positions between the micro-lens units 120 in different positions and a certain LED lamp bead 102 are different. The light converging effect of the micro-lens unit 120 is closely related to the distance of the light source and the incident angle of the light, and the difference in distance and relative position will cause a different in the light converging effect of the micro-lens unit 120.

For a certain LED lamp bead 102, the light emitted by the certain LED lamp bead 102 is mainly concentrated in the front. The greater the exit angle, the lower the intensity of the light. Therefore, how to make the light directly in the front of the LED lamp 102 approach the parallel light is the key to improving the brilliance of the crystal decoration. Therefore, among the plurality of micro-lens units 120 on the light-transmitting cover 12, a micro-lens unit 120 that basically right faces the LED lamp bead 102 is found, after the light emitted by the LED lamp bead 102 is distributed by the micro-lens unit 120 right facing the LED lamp bead 102, if the emitted light after being distributed can be substantially parallel, that is, if the maximum angle difference does not exceed 3°, a better light distribution effect can be obtained.

Because the light-transmitting cover 12 is integrally covered on the light source module 10, the light-transmitting cover 12 has a unified inner surface. In this example, the inner surface is the collection of the light incident surfaces 120*a* of the micro-lens units 120. Calculated according to the size of the light bulb in the usual crystal lamp, in order to achieve a better light distribution effect, a shortest distance between the inner surface of the light-transmitting cover 12 and the LED lamp beads 102 ranges from 8 mm to 18 mm. That is, the distance between the light incident surface 120*a* of the micro-lens unit 120 right facing the LED lamp bead 102 and the LED lamp bead 102 ranges from 8 mm to 18 mm, and the other micro-lens units 120 is gradually away from the LED lamp bead 102 because of different positions.

The size of the micro-lens unit 120 itself also has a great influence on the light distribution effect. If a projection area of the micro-lens unit 120 itself on a projection surface perpendicular to the direction from the light incident surface 120*a* to the light exit surface 120*b* is larger, the maximum angle difference of the incident light received by the light incident surface 120*a* will correspondingly increase. In this case, in order to reduce the maximum angle difference of the emitted light to be within 3°, the micro-lens unit 120 needs to have a greater curvature, and this curvature will increase the overall thickness of the light-transmitting cover 12, which will not only affect the appearance of the light bulb, but also increase the molding difficulty and the cost of materials.

The overall thickness of the light-transmitting cover 12 is generally thin, usually only 1 mm-2 mm, and therefore, the projection area of the micro-lens unit 120 itself on the projection surface perpendicular to the direction from the light incident surface 120*a* to the light exit surface 120*b* should not be too large. It is verified by experiments that the projection area being within a range of 9 $mm^2$-16 $mm^2$ is better.

For the micro-lens unit 120, the converging light configuration requires that at least one selected from a group consisting of the light incident surface 120*a* and the light exit surface 120*b* is a curved line in a cross section parallel to the direction from the light incident surface 120*a* to the light exit surface 120*b*. Only the light incident surface 120*a* may be a curved line (referring to FIG. 5), or only the light exit surface 120*b* may be a curved line (referring to FIG. 6). Of course, both the light incident surface 120*a* and the light exit surface 120*b* may be curved lines (referring to FIG. 7). In this example, it is preferable to adopt a configuration in which only the light exit surface 120*b* is a curved line and the light incident surface 120*a* is a straight line. In this way, the inner surface of the light-transmitting cover 12 can be a smooth and even surface, which is more convenient for injection molding.

Because the LED lamp beads 102 in this example are arranged at least on the circumferential surface 100*a*, in order to fully distribute the light of the LED lamp beads 102 on the circumferential surface 100*a*, the light-transmitting cover 12 includes a cylindrical portion 12*a*, and the cylindrical portion 12*a* is provided to cover the periphery of the circumferential surface 100*a*. In order to facilitate the formation of the cylindrical structure, the outline of the micro-lens unit 120 on the cylindrical portion 12*a* in the direction perpendicular to the direction from the light incident surface 120*a* to the light exit surface 120*b* may be in a square shape. In this way, the micro-lens units 120 are arranged in sequence along the circumferential direction and the axial direction of the cylindrical portion 12*a* to form the cylindrical structure.

The cylindrical portion 12*a* has a top opening (not numbered in the figure) adjacent to the top surface 100*b*. Because the light emitting angle of the LED lamp bead 102 is relatively large, part of the light may also be emitted out from the top opening. In order to also distribute this part of the light, the light-transmitting cover 12 in this example may further include a hemispherical portion 12*b*, the hemispherical portion 12*b* is arranged to cover the periphery of the top surface 100*b*, and the hemispherical portion 12*b* closes the top opening. In this way, the light emitted out from the top opening can be distributed by the hemispherical portion 12*b*, thereby forming an outgoing light beam closer to parallel light.

In order to make full use of the area of the hemispherical portion 12*b*, the outline of the micro-lens unit 120 on the hemispherical portion 12*b* is in a pentagonal shape or a hexagonal shape in the direction perpendicular to the direction from the light incident surface 120*a* to the light exit surface 120*b*. A sphere, which is similar to the surface of a football, can be formed by the combination of the pentagonal shape and the hexagonal shape. Of course, in this example, the LED lamp beads 102 may also be arranged on the top surface 100*b* to increase the light intensity of the top surface 100*b*. In this case, the hemispherical portion 12*b* can also be used to distribute light for the LED lamp beads 102 arranged on the top surface 100*b*.

Generally, the LED lamp beads 102 need to be installed on a flat surface. Therefore, in order to facilitate the installation of the LED lamp beads 102, the circumferential surface of the mounting column 100 is preferably formed by a plurality of flat surfaces that surround together. Theoretically, the light exit angle of the LED lamp bead 102 is 180°, so only the front and back sides may be required. However, the existing LED lamp bead 102 has very low light intensity at a large angle, so a very obvious dark region will be formed, which is not conducive to uniform light emission. The use of three flat surfaces can greatly alleviate this problem, but calculated based on the general illumination range of the current LED lamp bead 102, this structure usually also has three obvious dark regions. Therefore, the cross section of the circumferential surface of the mounting column 100 in this example is preferably a square, that is, the circumferential surface has four flat surfaces. LED lamp beads 102 are arranged on each surface of the square. In this way, the illumination of the light source module 10 in the circumferential direction can be more uniform, and there is basically no obvious dark region.

Further increasing the number of flat surfaces on this basis can theoretically make the illumination more uniform, but too many flat surfaces will cause a reduction in the width of a single flat surface, thereby increasing the setting difficulty of the LED lamp beads 102. In order to increase the width of the flat surface, increasing the overall diameter of the mounting column 100 is lost than gained, which will not only increase the volume of the light bulb, but also greatly increase the cost.

Preferably, in the aforementioned light bulb, a maximum angle difference of emitted light of one LED lamp bead after being distributed by a micro-lens unit facing the one LED lamp bead is not more than 3°.

Preferably, in the aforementioned light bulb, a shortest distance between an inner surface of the light-transmitting cover and the plurality of LED lamp beads ranges from 8 mm to 18 mm.

Preferably, in the aforementioned light bulb, a projection area of each of the plurality of micro-lens units on a projection surface perpendicular to a direction from the light incident surface to the light exit surface ranges from 9 $mm^2$ to 16 $mm^2$.

Preferably, in the aforementioned light bulb, at least one selected from a group consisting of the light incident surface and the light exit surface is a curved line in a cross section parallel to a direction from the light incident surface to the light exit surface.

Preferably, in the aforementioned light bulb, the light incident surface is a straight line in the cross section parallel to the direction from the light incident surface to the light exit surface.

Preferably, in the aforementioned light bulb, the light-transmitting cover comprises a cylindrical portion, and the cylindrical portion is arranged to cover a periphery of the circumferential surface.

Preferably, in the aforementioned light bulb, an outline of the micro-lens unit on the cylindrical portion in a direction perpendicular to a direction from the light incident surface to the light exit surface is in a square shape.

Preferably, in the aforementioned light bulb, the light-transmitting cover further comprises a hemispherical portion, the cylindrical portion has a top opening adjacent to the top surface, the hemispherical portion is arranged to cover a periphery of the top surface, and the hemispherical portion closes the top opening.

Preferably, in the aforementioned light bulb, an outline of the micro-lens unit on the hemispherical portion in a direction perpendicular to a direction from the light incident surface to the light exit surface is in a pentagonal shape or a hexagonal shape.

Preferably, in the aforementioned light bulb, the plurality of LED lamp beads are further arranged on the top surface.

Preferably, in the aforementioned light bulb, a cross section of the circumferential surface of the mounting column is a square, and the plurality of LED lamp beads are arranged on each surface of the square.

Preferably, in the aforementioned light bulb, the plurality of LED lamp beads are arranged on the circumferential surface along a circumferential direction and an axial direction of the mounting column.

Preferably, in the aforementioned light bulb, the light bulb further comprises a lamp holder, the light emitting module and the light-transmitting cover are fixedly arranged on the lamp holder.

Figure 9:
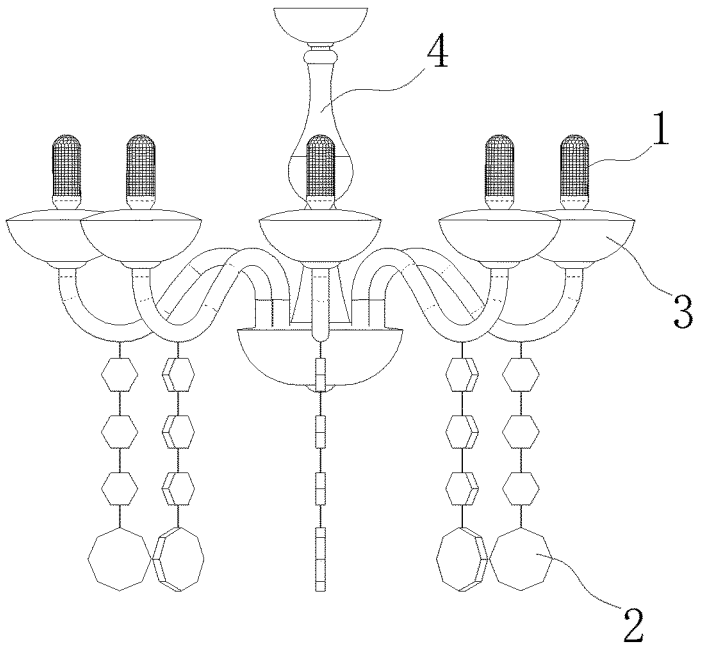
FIG. 9 is an overall structural view of a crystal lamp disclosed by an example of the present disclosure.

As shown in FIG. 9, another example of the present disclosure further provides a crystal lamp, which includes any one of the light bulbs 1 in the above examples, in addition, the crystal lamp further includes a crystal decoration 2, a lamp cap 3, a lamp stand 4, and the like. The lamp stand 4 is the main structure of the crystal lamp, and the crystal decoration 2 and the lamp cap 3 are both fixed on the lamp stand 4. The light bulb 1 is installed on the lamp cap 3 through the lamp holder 14, and the light emitted by the light bulb 1 can irradiate the crystal decoration 2 to make the crystal decoration dazzling.

The light bulb and the crystal lamp disclosed by the examples of the present disclosure can make the crystal decoration more dazzling.

The above examples of the present disclosure focus on the differences between the respective examples. As long as the different optimization features in the respective examples are not contradictory, the different optimization features can be combined to form more optimal examples. Considering the simplicity and concise of the specification, it is not repeated here.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The above descriptions are only specific examples of the present disclosure, and are not used to limit the present disclosure. For those skilled in the art, the present disclosure can have various modifications and changes. Any modifications, equivalent replacements, improvements, etc. made within the spirit and principle of the present disclosure shall be included in the scope of the claims of the present disclosure.

What is claimed is:

1. A light bulb, comprising:

a light emitting module and a light-transmitting cover;

wherein the light emitting module comprises a mounting column and a plurality of LED lamp beads, the mounting column comprises a circumferential surface and a top surface, and the plurality of LED lamp beads are disposed at least on the circumferential surface; and wherein the light-transmitting cover is disposed to cover a periphery of the light emitting module and distributes light for the plurality of LED lamp beads, the light-transmitting cover comprises a plurality of micro-lens units, and each of the plurality of micro-lens units comprises a light incident surface and a light exit surface, and is configured to direct light from the light incident surface to the light exit surface, all the plurality of micro-lens units are sequentially connected to form the light-transmitting cover, and each light incident surface faces the light emitting module, and each light exit surface is away from the light emitting module, wherein the light-transmitting cover comprises a cylindrical portion and a hemispherical portion, and light emitted from a top opening of the cylindrical portion is distributed by the hemispherical portion to form an outgoing light beam closer to parallel light, and wherein the hemispherical portion is formed by a combination of micro-lens units comprising both pentagonal shape and hexagonal shape, and the light-transmitting cover comprises a combination of micro-lens units of pentagonal shape, hexagonal shape, and square shape.

2. The light bulb according to claim 1, wherein a maximum angle difference of emitted light of one LED lamp bead after being distributed by a micro-lens unit facing the one LED lamp bead is not more than 3°.

3. The light bulb according to claim 1, wherein a shortest distance between an inner surface of the light-transmitting cover and the plurality of LED lamp beads ranges from 8 mm to 18 mm.

4. The light bulb according to claim 1, wherein a projection area of each of the plurality of micro-lens units on a projection surface perpendicular to a direction from the light incident surface to the light exit surface ranges from 9 $mm^2$ to 16 $mm^2$.

5. The light bulb according to claim 1, wherein at least one selected from a group consisting of the light incident surface and the light exit surface is a curved line in a cross section parallel to a direction from the light incident surface to the light exit surface.

6. The light bulb according to claim 1, wherein the light incident surface is a straight line in a cross section parallel to a direction from the light incident surface to the light exit surface.

7. The light bulb according to claim 1, wherein the cylindrical portion is disposed to cover a periphery of the circumferential surface.

8. The light bulb according to claim 7, wherein an outline of the micro-lens unit on the cylindrical portion in a direction perpendicular to a direction from the light incident surface to the light exit surface is in a square shape.

9. The light bulb according to claim 7, wherein the cylindrical portion has a top opening adjacent to the top surface, the hemispherical portion is arranged to cover a periphery of the top surface, and the hemispherical portion closes the top opening.

10. The light bulb according to claim 9, wherein an outline of the micro-lens unit on the hemispherical portion in a direction perpendicular to a direction from the light incident surface to the light exit surface is in a pentagonal shape or a hexagonal shape.

11. The light bulb according to claim 9, wherein the plurality of LED lamp beads are further disposed on the top surface.

12. The light bulb according to claim 1, wherein a cross section of the circumferential surface of the mounting column is a square, and the plurality of LED lamp beads are arranged on each surface of the square.

13. The light bulb according to claim 1, wherein the plurality of LED lamp beads are disposed on the circumferential surface along a circumferential direction and an axial direction of the mounting column.

14. The light bulb according to claim 1, further comprising:

a lamp holder, wherein the light emitting module and the light-transmitting cover are fixedly disposed on the lamp holder.

15. A crystal lamp, comprising:

a crystal decoration and a light bulb comprising a light emitting module and a light-transmitting cover, wherein light emitted by the light bulb is capable of irradiating the crystal decoration;

wherein the light emitting module comprises a mounting column and a plurality of LED lamp beads, the mounting column comprises a circumferential surface and a top surface, and the plurality of LED lamp beads are disposed at least on the circumferential surface; and wherein the light-transmitting cover is disposed to cover a periphery of the light emitting module and distributes light for the plurality of LED lamp beads, the light-transmitting cover comprises a plurality of micro-lens units, and each of the plurality of micro-lens units comprises a light incident surface and a light exit surface, and is configured to direct light from the light incident surface to the light exit surface, all the plurality of micro-lens units are sequentially connected to form the light-transmitting cover, and each light incident surface faces the light emitting module, and each light exit surface is away from the light emitting module, wherein the light-transmitting cover comprises a cylindrical portion and a hemispherical portion, and light emitted from a top opening of the cylindrical portion is distributed by the hemispherical portion to form an outgoing light beam closer to parallel light, and wherein the hemispherical portion is formed by a combination of micro-lens units comprising both pentagonal shape and hexagonal shape, and the light-transmitting cover comprises a combination of micro-lens units of pentagonal shape, hexagonal shape, and square shape.

16. The crystal lamp according to claim 15, wherein a maximum angle difference of emitted light of one LED lamp bead after being distributed by a micro-lens unit facing the one LED lamp bead is not more than 3°.

17. The crystal lamp according to claim 15, wherein a shortest distance between an inner surface of the light-transmitting cover and the plurality of LED lamp beads ranges from 8 mm to 18 mm.

18. The crystal lamp according to claim 15, wherein a projection area of each of the plurality of micro-lens units on a projection surface perpendicular to a direction from the light incident surface to the light exit surface ranges from 9 $mm^2$ to 16 $mm^2$.

19. The crystal lamp according to claim 15, wherein at least one selected from a group consisting of the light incident surface and the light exit surface is a curved line in a cross section parallel to a direction from the light incident surface to the light exit surface.

20. The crystal lamp according to claim 15, wherein the light incident surface is a straight line in a cross section parallel to a direction from the light incident surface to the light exit surface.

* * * * *